US011408062B2

(12) United States Patent
Crafton et al.

(10) Patent No.: US 11,408,062 B2
(45) Date of Patent: Aug. 9, 2022

(54) SYSTEM AND METHOD FOR HEAT TREATING ALUMINUM ALLOY CASTINGS

(71) Applicant: Consolidated Engineering Company, Inc., Kennesaw, GA (US)

(72) Inventors: Scott P. Crafton, Marietta, GA (US); Shanker Subramaniam, Marietta, GA (US); Paul Fauteux, Douglasville, GA (US)

(73) Assignee: Consolidated Engineering Company, Inc., Kennesaw, GA (US)

( * ) Notice: Subject to any disclaimer, the term of this patent is extended or adjusted under 35 U.S.C. 154(b) by 221 days.

(21) Appl. No.: 16/688,153

(22) Filed: Nov. 19, 2019

(65) Prior Publication Data

US 2020/0190648 A1 Jun. 18, 2020

Related U.S. Application Data

(63) Continuation of application No. 15/140,533, filed on Apr. 28, 2016, now abandoned.

(Continued)

(51) Int. Cl.

*C22F 1/043* (2006.01)
*C22C 21/02* (2006.01)

(Continued)

(52) U.S. Cl.

CPC ..... *C22F 1/043* (2013.01); *C21D 1/63* (2013.01); *C21D 1/667* (2013.01); *C21D 9/0056* (2013.01);

(Continued)

(58) Field of Classification Search

CPC . C22F 1/043; C22F 1/002; C21D 1/63; C21D 1/667; C21D 9/0056; C21D 9/0062; C22C 21/02; B22D 17/00; B22D 21/007

See application file for complete search history.

(56) References Cited

U.S. PATENT DOCUMENTS 2,385,962 A 10/1945 Barnett
2,813,318 A 11/1957 Horth (Continued)

FOREIGN PATENT DOCUMENTS

CA 1197981 12/1985 ..... D01J 8/18
CN 101001963 A 7/2007

(Continued)

OTHER PUBLICATIONS

Experimental Determination of 2-Component Phase Diagrams—Two Component (Binary) Phase Diagrams—Tulane University—Prof. Stephen A. Nelson—Feb. 7, 2011 (12 pages).

(Continued)

*Primary Examiner* — John A Hevey

(74) *Attorney, Agent, or Firm* — Womble Bond Dickinson (US) LLP

(57) ABSTRACT

A method for heat treating cast aluminum alloy components that includes obtaining a casting formed from an aluminum alloy having a silicon constituent and at least one metal alloying constituent, and heating the casting to a first casting temperature that is below but within 10° C. of a predetermined silicon solution temperature at which the silicon constituent rapidly enters into solid solution. The method also includes increasing the rate of heat input into the casting to raise the temperature of the casting to a second casting temperature that is above but within 10° C. of a predetermined alloying metal solution temperature at which the at least one metal alloying constituent rapidly enters into solid solution, maintaining the casting at the second casting temperature for a period of time that is less than about 20 minutes, and then quenching the casting to a temperature less than or about 250° C.

18 Claims, 4 Drawing Sheets

Related U.S. Application Data

(60) Provisional application No. 62/153,724, filed on Apr. 28, 2015.

(51) Int. Cl.

| | |
|---|---|
| ***C21D 9/00*** | (2006.01) |
| ***C21D 1/63*** | (2006.01) |
| ***B22D 17/00*** | (2006.01) |
| ***B22D 21/00*** | (2006.01) |
| ***C21D 1/667*** | (2006.01) |

(52) U.S. Cl.

CPC ..... *C21D 9/0062* (2013.01); *C22C 21/02* (2013.01); *B22D 17/00* (2013.01); *B22D 21/007* (2013.01)

(56) References Cited

U.S. PATENT DOCUMENTS

| | | | |
|---|---|---|---|
| 2,988,351 | A | 6/1961 | Barnett et al. |
| 3,194,545 | A | 7/1965 | Smith |
| 3,222,227 | A | 12/1965 | Baugh et al. |
| 3,432,368 | A | 3/1969 | Nakamura |
| 3,534,946 | A | 10/1970 | Wasterkamp et al. |
| 3,604,695 | A | 9/1971 | Steeper |
| 3,675,905 | A | 7/1972 | Placek |
| 3,737,280 | A | 6/1973 | Cromp |
| 3,760,800 | A | 9/1973 | Staffin et al. |
| 3,794,232 | A | 2/1974 | Petri |
| 3,856,583 | A | 12/1974 | Sanders et al. |
| 3,871,438 | A | 3/1975 | Vissers et al. |
| 3,977,911 | A | 8/1976 | Takase |
| 3,996,412 | A | 12/1976 | Schaefer et al. |
| 4,021,272 | A | 5/1977 | Asai et al. |
| 4,027,862 | A | 6/1977 | Schaefer et al. |
| 4,068,389 | A | 1/1978 | Staffin et al. |
| 4,098,624 | A | 7/1978 | Laird, Jr. |
| 4,140,467 | A | 2/1979 | Ellison et al. |
| 4,161,389 | A | 7/1979 | Staffin et al. |
| 4,177,085 | A | 12/1979 | Chadwick et al. |
| 4,177,952 | A | 12/1979 | Rikker |
| 4,211,274 | A | 7/1980 | Slowinski et al. |
| 4,242,077 | A | 12/1980 | Hyre |
| 4,255,133 | A | 3/1981 | Tanifuji et al. |
| 4,257,767 | A | 3/1981 | Price |
| 4,294,436 | A | 10/1981 | Takahashi |
| 4,325,424 | A | 4/1982 | Scheffer |
| 4,338,077 | A | 7/1982 | Shibayama et al. |
| 4,340,433 | A | 7/1982 | Harding |
| 4,357,135 | A | 11/1982 | Wilde et al. |
| 4,392,814 | A | 7/1983 | Harding |
| 4,411,709 | A | 10/1983 | Nakanishi |
| 4,415,444 | A | 11/1983 | Guptail |
| 4,419,143 | A | 12/1983 | Ito et al. |
| 4,420,345 | A | 12/1983 | Ito et al. |
| 4,457,352 | A | 7/1984 | Scheffer |
| 4,457,788 | A | 7/1984 | Staffin et al. |
| 4,457,789 | A | 7/1984 | Wilks |
| 4,478,572 | A | 10/1984 | Selli |
| 4,490,107 | A | 12/1984 | Kimura et al. |
| 4,499,940 | A | 2/1985 | Hall |
| 4,512,821 | A | 4/1985 | Staffin et al. |
| 4,519,718 | A | 5/1985 | Staffin et al. |
| 4,524,957 | A | 6/1985 | Staffin et al. |
| 4,544,013 | A | 10/1985 | Kearney et al. |
| 4,547,228 | A | 10/1985 | Girrell et al. |
| 4,577,671 | A | 3/1986 | Stephen |
| 4,579,319 | A | 4/1986 | Sasaki |
| 4,582,301 | A | 4/1986 | Wunning |
| 4,604,055 | A | 8/1986 | Mackenzie |
| 4,606,529 | A | 8/1986 | Fooch |
| 4,613,713 | A | 9/1986 | Staffin et al. |
| 4,620,586 | A | 11/1986 | Musschoot |
| 4,620,884 | A | 11/1986 | Heath |
| 4,623,400 | A | 11/1986 | Japka et al. |
| 4,648,836 | A | 3/1987 | Thom |
| 4,671,496 | A | 6/1987 | Girrell et al. |
| 4,681,267 | A | 7/1987 | Leidel et al. |
| 4,700,766 | A | 10/1987 | Godderidge |
| 4,752,061 | A | 6/1988 | Dalton et al. |
| 4,779,163 | A | 10/1988 | Bickford et al. |
| 4,817,920 | A | 4/1989 | Erfort, Jr. |
| 4,830,605 | A | 5/1989 | Hodate et al. |
| 4,832,764 | A | 5/1989 | Merz |
| 4,878,952 | A | 11/1989 | Pillhoefer |
| 4,955,425 | A | 9/1990 | McKenna |
| 5,018,707 | A | 5/1991 | Hemsath et al. |
| 5,108,519 | A | 4/1992 | Armanie et al. |
| 5,108,520 | A | 4/1992 | Liu et al. |
| 5,115,770 | A | 5/1992 | Yen et al. |
| 5,120,372 | A | 6/1992 | Yen et al. |
| 5,156,800 | A | 10/1992 | Buchet et al. |
| 5,169,913 | A | 12/1992 | Staffin et al. |
| 5,178,695 | A | 1/1993 | LaSalle et al. |
| 5,226,983 | A | 7/1993 | Skinner et al. |
| 5,251,683 | A | 10/1993 | Backer |
| 5,253,698 | A | 10/1993 | Keough et al. |
| 5,294,094 | A | 3/1994 | Crafton et al. |
| 5,298,094 | A | 3/1994 | Ota et al. |
| 5,306,359 | A | 4/1994 | Eppeland et al. |
| 5,308,410 | A | 5/1994 | Hurimura et al. |
| 5,312,498 | A | 5/1994 | Anderson |
| 5,336,344 | A | 8/1994 | Wei |
| 5,340,089 | A | 8/1994 | Heath et al. |
| 5,340,418 | A | 8/1994 | Wei |
| 5,350,160 | A | 9/1994 | Crafton et al. |
| 5,354,038 | A | 10/1994 | Crafton |
| 5,378,434 | A | 1/1995 | Staffin et al. |
| 5,423,370 | A | 6/1995 | Bonnemersou et al. |
| 5,439,045 | A | 8/1995 | Crafton |
| 5,485,985 | A | 1/1996 | Eppeland et al. |
| 5,514,228 | A | 5/1996 | Wyatt-Mair et al. |
| 5,518,557 | A | 5/1996 | Jones et al. |
| 5,531,423 | A | 7/1996 | Crafton et al. |
| 5,536,337 | A | 7/1996 | Wei |
| 5,547,523 | A | 8/1996 | Blakenship, Jr. et al. |
| 5,551,670 | A | 9/1996 | Heath et al. |
| 5,551,998 | A | 9/1996 | Crafton et al. |
| 5,565,046 | A | 10/1996 | Crafton et al. |
| 5,571,347 | A | 11/1996 | Bergsma |
| 5,593,519 | A | 1/1997 | Blankenship, Jr. et al. |
| 5,643,372 | A | 7/1997 | Sainfort et al. |
| 5,738,162 | A | 4/1998 | Crafton |
| 5,829,509 | A | 11/1998 | Crafton |
| 5,850,866 | A | 12/1998 | Crafton |
| 6,074,501 | A | 6/2000 | Baxter et al. |
| 6,112,803 | A | 9/2000 | Kruger |
| 6,125,911 | A | 10/2000 | Wust |
| 6,217,317 | B1 | 4/2001 | Crafton et al. |
| 6,325,873 | B1 | 12/2001 | Pollkoetter |
| 6,672,367 | B2 | 1/2004 | Crafton et al. |
| 6,910,522 | B2 | 6/2005 | Crafton et al. |
| 6,910,990 | B2 | 6/2005 | Howard et al. |
| 7,025,839 | B2 | 4/2006 | Lumley et al. |
| 7,037,391 | B2 | 5/2006 | Lumley et al. |
| 7,258,755 | B2 | 8/2007 | Crafton et al. |
| 7,338,629 | B2 | 3/2008 | Crafton et al. |
| 8,409,374 | B2 * | 4/2013 | Lumley ..... C22F 1/04 148/549 |
| 2002/0104596 | A1 | 8/2002 | Crafton et al. |
| 2004/0035546 | A1 | 2/2004 | DiSerio |
| 2005/0072549 | A1 | 4/2005 | Crafton et al. |
| 2005/0217771 | A1 | 10/2005 | Meyer et al. |
| 2005/0257858 | A1 | 11/2005 | Crafton et al. |
| 2005/0269751 | A1 * | 12/2005 | Crafton ..... C21D 11/00 266/87 |
| 2009/0288740 | A1 | 11/2009 | Westerheide et al. |
| 2009/0314392 | A1 | 12/2009 | Wuerst et al. |
| 2010/0101689 | A1 | 4/2010 | Wust et al. |
| 2010/0101691 | A1 | 4/2010 | Doty |
| 2010/0224289 | A1 | 9/2010 | Wang et al. |
| 2010/0224293 | A1 | 9/2010 | Wang et al. |

(56) References Cited

U.S. PATENT DOCUMENTS

| | | | |
|---|---|---|---|
| 2010/0243113 A1 | 9/2010 | Mishra et al. | |
| 2013/0269843 A1 | 10/2013 | Wust et al. | |

FOREIGN PATENT DOCUMENTS

| | | | | |
|---|---|---|---|---|
| CN | 101724796 A | | 9/2010 | |
| CN | 102000813 A | | 4/2011 | |
| CN | 103534364 A | | 1/2014 | |
| CN | 103930577 A | | 7/2014 | |
| DE | 2307773 | | 2/1973 | B22C 5/02 |
| DE | 2323805 | | 5/1973 | |
| DE | 2310541 | | 9/1973 | |
| DE | 2315958 | | 4/1974 | B08B 5/00 |
| DE | 2337894 | | 11/1974 | B08B 7/04 |
| DE | 2914221 | | 4/1979 | B22C 29/00 |
| DE | 3206048 | | 2/1982 | B22D 21/04 |
| DE | 4012158 | | 11/1990 | B22C 5/13 |
| DE | 195 30 975 | | 2/1997 | B22D 29/00 |
| DE | 10 2006 049 869 | A1 | 4/2008 | C22F 1/04 |
| DE | 10 2008 056 511 | A1 | 5/2010 | |
| DE | 102008056511 | A1 * | 5/2010 | C22F 1/05 |
| DE | 10 2011 105 447 | A1 | 12/2012 | C22F 1/04 |
| DE | 10 2011 122 764 | A1 | 12/2012 | |
| EP | 0 485 068 | A1 | 5/1992 | |
| EP | 0546210 | | 6/1993 | B22D 29/00 |
| EP | 0610028 | | 8/1994 | F27D 3/00 |
| EP | 0 621 904 | | 11/1994 | |
| FR | 7043571 | | 12/1970 | G01N 15/00 |
| FR | 2448573 | | 2/1979 | C21D 9/00 |
| GB | 1392405 | | 4/1975 | G01N 25/00 |
| GB | 1564151 | | 4/1980 | F27B 15/00 |
| GB | 1569152 | | 6/1980 | F23G 7/00 |
| GB | 2187398 | | 9/1987 | F27B 15/09 |
| GB | 2230720 | | 10/1990 | |
| JP | 355149772 A | | 11/1980 | B22D 27/04 |
| JP | 5653867 | | 5/1981 | B22D 29/00 |
| JP | 5939464 | | 8/1982 | C21D 1/74 |
| JP | 5825417 | | 2/1983 | C21D 1/00 |
| JP | 5825860 | | 2/1983 | B22D 29/00 |
| JP | 59219410 | | 12/1984 | C21D 1/63 |
| JP | 6092040 | | 5/1985 | B22D 17/22 |
| JP | 6274022 | | 4/1987 | C21D 5/00 |
| JP | 6316853 | | 1/1988 | B22D 29/00 |
| JP | 62110248 | | 5/1988 | |
| JP | 63108941 | | 5/1988 | B22C 5/00 |
| JP | 1-91957 | | 4/1989 | B22D 29/00 |
| JP | 1-122658 | | 5/1989 | B22D 29/00 |
| JP | 2104164 | | 8/1990 | B22D 29/00 |
| JP | 3-465 | | 1/1991 | B22D 29/00 |
| JP | 11-29843 | | 2/1999 | |
| JP | 2005-264301 | | 9/2005 | |
| JP | 2006-265582 | | 10/2006 | |
| JP | 4341453 | | 7/2009 | |
| KR | 10-2007-0052361 | | 5/2007 | |
| KR | 10-2007-0091669 | | 9/2007 | |
| SU | 1129012 | | 7/1982 | B22C 5/00 |
| SU | 0234810 | | 3/1985 | B22D 29/00 |
| WO | WO 97/30805 | | 8/1997 | B22D 29/00 |
| WO | WO 98/14291 | | 4/1998 | B22D 29/00 |
| WO | WO 00/36354 | | 6/2000 | F27B 5/04 |
| WO | WO 02/063051 | | 8/2002 | B22D 29/00 |
| WO | WO 06/066314 | | 6/2006 | C22F 1/04 |

OTHER PUBLICATIONS

Edgar Lange; Perfect Aluminum Casting; Casting Plant & Technology Jan. 2003; pp. 2-4.

Omgega Research, Inc.; Aluminum-Mettallurgy—What Metal Finishers Should Know; 6 pages.

R.N.Lumley et al.; The role of alloy composition in the heat treatment of aluminum high pressure die castings; Metallurgical Science & Technology; 2008—vol. 26-2; pp. 2-11.

R.N. Lumley; Materials Science & Technologies; The Potential for Cost and Weigh Reduction in Transport Applications through the use of Heat Treated Aluminum High Pressure Diecastings; 2010 Nova Science Publishers, Inc.

Written Opinion of the International Searching Authority dated Jul. 29, 2016; from corresponding PCT Application No. PCT/US2016/029654.

Notification of Transmittal of the International Search Report & The Written Opinion of the International Searching Authority, or Declaration dated Jul. 29, 2016; from corresponding PCT Application No. PCT/US2016/029654.

Lampman, S.R. & Zorc T.B.: "ASM Handbook—Heat Treating, vol. 4" 1991, ASM International, USA, XP-002357244—pp. 529-541.

Economical Used Energy Type Continuing Heat Treating Furnance For Aluminum Castings Dogyo—Kanetsu vol. 21 No. 2 pp. 29-36—Mar. 1984.

Brochures describing Beardsley & Pipe PNEU-RECLAIM Sand Reclamation Units Prior to Aug. 13, 1992.

Brochure describing Fataluminum Sand Reclamation Units—Prior to Aug. 13, 1992.

Paul M. Crafton—Heat Treating Aging System Also Permits Core Sand Removal—Reprinted from Sep. 1989 Modern Castings magazine.

ASM Handbook, vol. 4 Heat Treating, pp. 465-474, Apr. 1993.

The Making, Shaping and Treating of Steel, 10$^{th}$ edition, pp. 1267-1276, Dec. 1989.

Sales brochure describing Thermfire Brand Sand Reclamation, Gudgeon Bros., Ltd. Believed to be known to others prior to Sep. 1989.

Sales brochure describing Simplicity/Richards Gas-Fired Thermal Reclamation System Simplicity Engineering, Inc.—believed to be known to others prior to Sep. 1989.

Sales brochure describing AirTrac Brand Fluidizing Conveyor, AirTrac Systems Corp., believed to be known to others prior to Sep. 1989.

Sales brochure describing Fluid Bed Calcifer Thermal Sand Reclamation Systems, Dependable Foundry Equipment Co.,—Believed to be known to others prior to Sep. 1989.

Foundry Management & Technology—Dec. 1989—vol. 117; No. 12; p. G3—Shakeout/Cleaning/Finishing Brouchure.

Supplementary European Search Report dated Oct. 17, 2018, from European Patent Application No. 16787101.1.

Diffusion of Silicon in Aluminum—Shin-Ichiro et al.—vol. 9A, Dec. 1978—pp. 1811-1815.

The Development of High Strength and Ductility in High-Pressure Die-Cast Al—Si—Mg Alloys from Secondary Sources—Roger Lumley—Published online Sep. 10, 2018—pp. 382-390.

Ductile Aluminum High-Pressure Die Casting Alloys for Automotive Applications—Koch & Franke, Aluminum Rheinfelden GmbH—Oct. 2004—pp. 6-11.

Designations and Chemical Composition Limits for Aluminum Alloys in the Form of Castings and Ingot—The Aluminum Association—Revised: Dec. 2015 Supersedes: Nov. 2009—Registration Record Series Pink Sheets.

Standard Practice for Heat Treatment of Aluminum Alloys—Designation: B 597-92 (Reapproved 1998)—pp. 1-15.

Effect of Iron in Al—Si Casting Alloys: A Critical Review—P.N. Crepeau—General Motors Powertrain Group—AFS Transactions—pp. 361-366.

Ductile Alloys for high pressure die casting—Stig Brusethaug and Jorunn Snoan Maeland—Casting Plant & Technology International Apr. 2004—pp. 16-23.

Iron in Aluminum Casting Alloys—A Literature Survey—A. Couture—AFS International Cast Metals Journal—Dec. 1981—pp. 9-17.

Aluminum and aluminum alloys—Castings—Chemical composition and mechanical properties English version of DIN EN 1706—Jun. 1998.

* cited by examiner

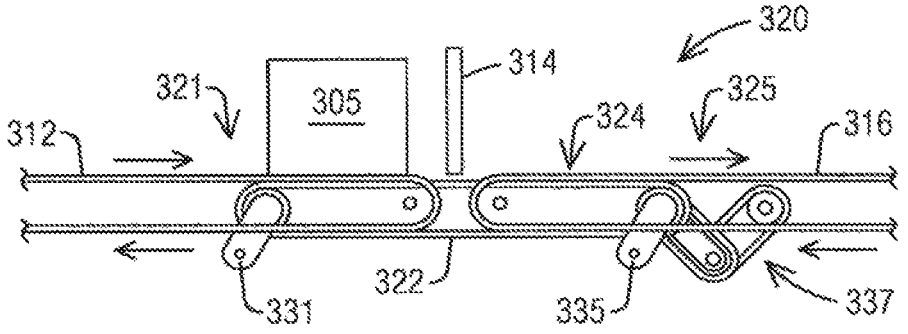
FIG. 7A
FIG. 7B
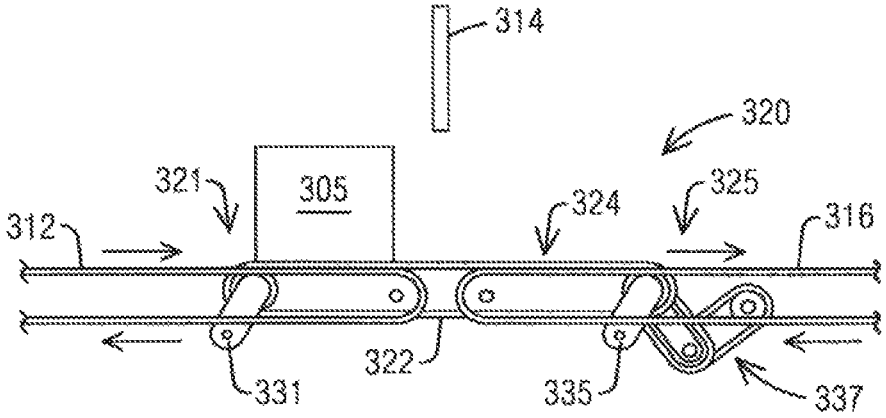
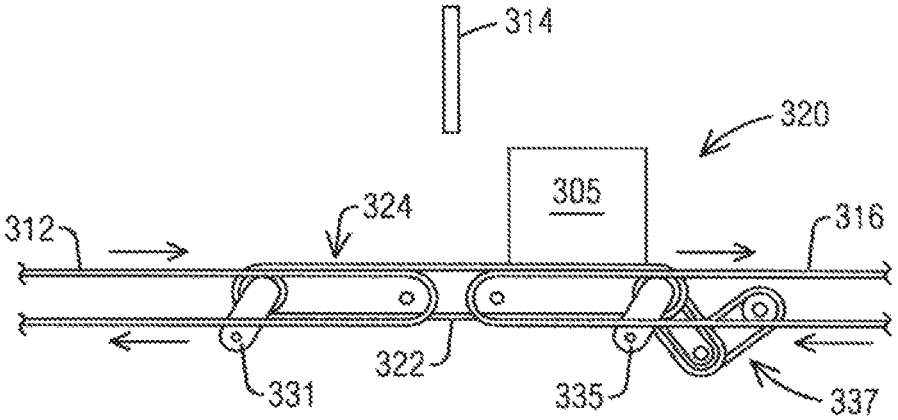
FIG. 7C
FIG. 7D
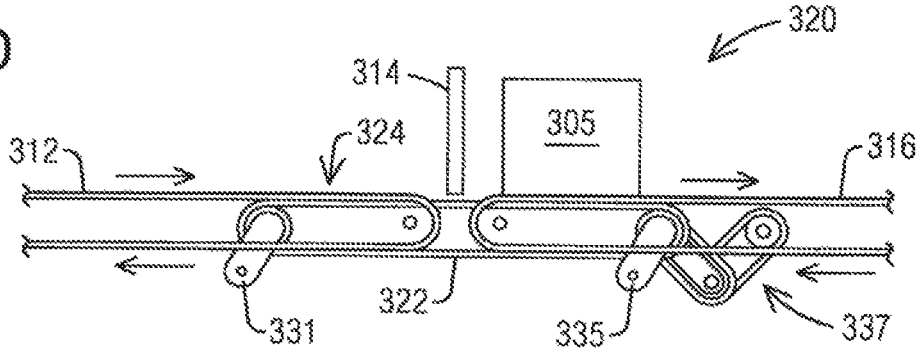

SYSTEM AND METHOD FOR HEAT TREATING ALUMINUM ALLOY CASTINGS

CROSS-REFERENCE TO RELATED APPLICATIONS

This application is a continuation of U.S. patent application Ser. No. 15/140,533, filed Apr. 28, 2016; which application claims the benefit of U.S. Provisional Patent Application No. 62/153,724, filed Apr. 28, 2015; which applications are incorporated by reference in their entirety herein, and for all purposes.

FIELD OF THE INVENTION

The present invention generally relates to the heat treatment of cast aluminum alloy components, and more specifically to the solution heat treatment of aluminum alloy castings formed in a high pressure die cast manufacturing process.

BACKGROUND

Interest in aluminum alloys as structural parts or components for automobiles and other vehicles has greatly increased in recent years, due to their potential for reducing weight while matching the yield strength and elongation properties of steel alloys. Unfortunately, the manufacture of structural components made from aluminum alloys continues to provide challenges for the transportation industries, as the typical processes for producing high quality and defect free parts remain costly and time consuming.

High Pressure Die Casting (HPDC) is one manufacturing process that can be used with aluminum alloys which holds great promise for producing quality cast parts or components at increased production rates for a substantially lower cost. This manufacturing technique also has its drawbacks, however, as aluminum alloy castings formed in an HPDC process often include a higher content of entrained or dissolved gases. It is generally recognized that the elevated gas content can lead to an increased number of internal and surface defects when the castings are subsequently heat treated to their solution temperatures (sometimes referred to as their solutionizing heat treatment temperatures) in a typical T4, T6 or T7 tempering process that will impart the cast components with their ultimate mechanical properties. The resulting high percentage of rejected scrap parts can substantially offset the other benefits of the HDPC process.

Consequently, a need exists for systems and methods for heat treating HPDC components which can better accommodate their high gas content while reducing the high scrap rates. It is toward such a system and method that the present disclosure is directed.

SUMMARY

Briefly described, one embodiment of the present disclosure comprises a method for heat treating a cast aluminum alloy component, or casting, having a silicon constituent and one or more metal alloying constituents. The silicon constituent has a predetermined silicon solution temperature, above which there is substantial or accelerated solutionizing of the silicon constituent (i.e. with the silicon rapidly entering into solid solution), and below which there is little or no substantial solutionizing of the silicon constituent. The one or more metal alloying constituents also have predetermined alloying metal solution temperatures above which the alloying metals rapidly enters into solid solution. The method includes heating the casting to a first casting temperature that is below, and preferably less than 10° C. below, the predetermined silicon solution temperature, and then increasing the rate of heat input into the casting to heat the casting to a second casting temperature that is above, and preferably less than 10° C. above, the predetermined alloying metal solution temperature. The method further includes maintaining the casting at the second casting temperature for a period of time that is less than or about 20 minutes, and then quenching the casting to a temperature less than or about 250° C.

In some embodiments the method also includes maintaining the casting at the second casting temperature for at least two minutes, or five minutes, or more, up to the 20 minutes disclosed above. For instance, in one aspect the casting can be maintained at the second casting temperature until the casting achieves a time-in-treatment ratio greater than 50%, with the time-in-treatment ratio being generally defined by the duration of time the casting spent above the predetermined alloying metal solution temperature divided by a duration of time the casting spent above the predetermined silicon solution temperature. In other aspects the casting can achieve a time-in-treatment ratio between 70% and 90%.

In accordance with another embodiment, the present disclosure also includes a system for heat treating aluminum alloy castings having a silicon constituent and one or more metal alloying constituents. The system includes a heat treatment furnace having a first heating stage maintained at a first stage temperature that is below, and preferably less than 10° C. below, a predetermined silicon solution temperature for the silicon constituent. The first heating stage is followed by a second heating stage that is configured to increase the rate of heat input into the casting to heat the casting to a second stage temperature that is above, and preferably less than 10° C. above, a predetermined alloying metal solution temperature for the at least one metal alloying constituent. The furnace also includes an intake door that defines the beginning of the first heating stage, an intermediate door separating the first heating stage and the second heating stage, a discharge door defining the end of the second heating stage, and a transport apparatus configured to convey a plurality of castings through the furnace enclosure from the intake door through to the discharge door. The transport apparatus may be configured to maintain each of the castings within the second heating stage for a period of time that is greater than 3 minutes and less than 30 minutes.

In one aspect the transport apparatus can be configured to convey the castings through the furnace at a substantially constant speed. and the location of the intermediate door along the length of the furnace is repositionable. In other aspects the transport apparatus can be configured to convey the castings through the first heating stage of the furnace at a first speed and through the second heating stage of the furnace at a second speed that is different from the first speed.

In accordance with yet another embodiment, the present disclosure also includes a method for heat treating aluminum alloy castings having a silicon constituent and one or more metal alloying constituents. The method includes the step of moving a casting into a first heating stage of a furnace maintained at a first stage temperature to heat the casting to a first casting temperature that is less than 10° C. below a predetermined silicon solution temperature for the silicon constituent. The method also includes the step of moving the casting from the first heating stage into a second heating stage of the furnace that is separate from the first heating stage and maintained at a second stage temperature that is greater than the first stage temperature, to increase the rate of heat input into the casting and heat the casting to a second casting temperature that is less than 10° C. above a predetermined alloying metal solution temperature for the at least one metal alloying constituent. The method further includes the steps of maintaining the casting at the second casting temperature for a period of time that is less than or about 20 minutes, removing the casting from the second heating stage of the furnace, and quenching the casting to a temperature less than or about 250° C.

The invention will be better understood upon review of the detailed description set forth below taken in conjunction with the accompanying drawing figures, which are briefly described as follows.

BRIEF DESCRIPTION OF THE DRAWINGS

FIGS. 7A-7D are schematic diagrams of a system for transferring castings between two conveyor chains, in accordance with yet another representative embodiment of the present disclosure.

Those skilled in the art will appreciate and understand that, according to common practice, various features and elements of the drawings described above are not necessarily drawn to scale, and that the dimensions of the various features and elements may be expanded or reduced to more clearly illustrate the embodiments of the present disclosure described therein.

DETAILED DESCRIPTION

The present disclosure relates to a system and method for heat treating cast aluminum alloy components, or castings, including but not limited to aluminum alloy components that are formed in a high pressure die cast manufacturing process. As described below, the system and method can provide several significant advantages and benefits over other systems and methods for heat treating similar cast aluminum alloy components. However, the recited advantages are not meant to be limiting in any way, as one skilled in the art will appreciate that other advantages may also be realized upon practicing the present disclosure.

In addition, those skilled in the relevant art will recognize that changes can be made to the described embodiments while still obtaining the beneficial results. It will also be apparent that some of the advantages and benefits of the described embodiments can be obtained by selecting some of the features of the embodiments without utilizing other features, and that features from one embodiment may be combined with features from other embodiments in any appropriate combination. For example, any individual or collective features of method embodiments may be applied to apparatus, product or system embodiments, and vice versa. Accordingly, those who work in the art will recognize that many modifications and adaptations to the embodiments described are possible and may even be desirable in certain circumstances, and are a part of the disclosure. Thus, the present disclosure is provided as an illustration of the principles of the embodiments and not in limitation thereof, since the scope of the invention is to be defined by the claims.

Figure 1:
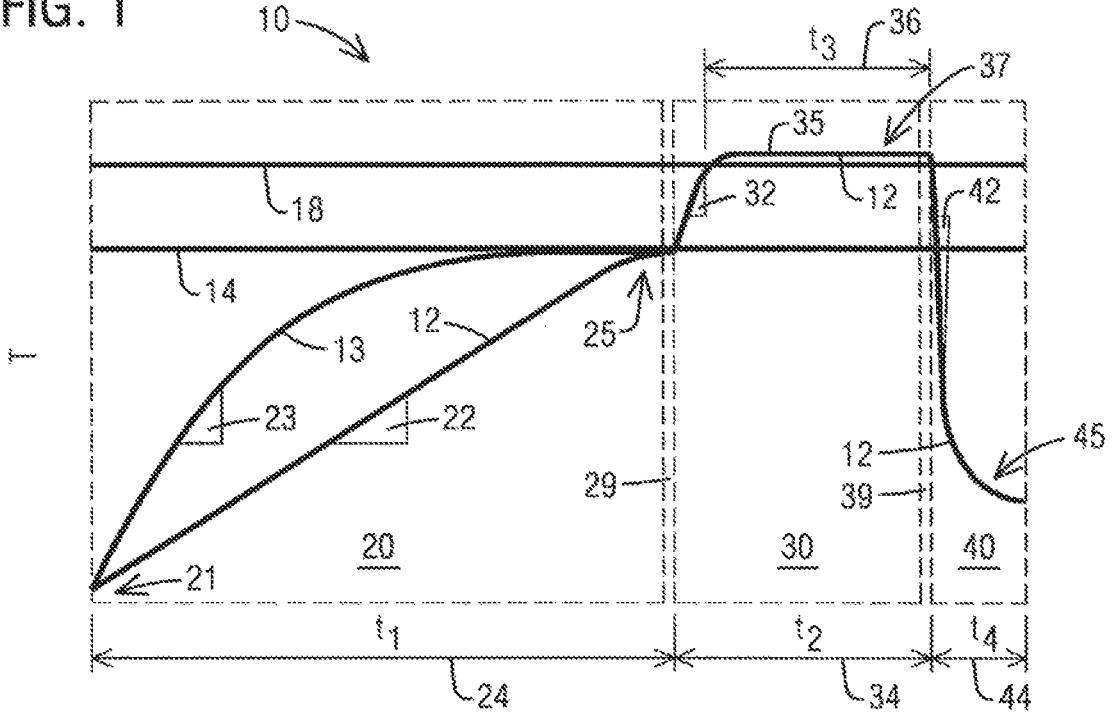
FIG. 1 is a graph of the temperature experienced by an cast aluminum alloy casting during a heat treatment process, in accordance with a representative embodiment of the present disclosure.

Referring now in more detail to the drawing figures, wherein like parts are identified with like reference numerals throughout the several views, FIG. 1 is a temperature vs time graph of the temperature 12 experienced by an aluminum alloy casting during of a heat treatment process or method 10, in accordance with one representative embodiment of the present disclosure. The casting is formed from an aluminum alloy that generally includes aluminum combined with a silicon constituent and one or more additional principal metal alloying constituents, such as copper, magnesium, manganese, nickel, iron, zinc, and the like, along with a variety of other metal alloying constituents in smaller proportions, including but not limited to lead, tin, chromium, and titanium. For example, in some common aluminum alloys the silicon constituent can comprise between about 6 weight percent and about 20 weight percent of the aluminum alloy, a copper constituent can comprise between about 0.5 weight percent and about 5 weight percent of the aluminum alloy, and a magnesium constituent comprising between about 0.4 weight percent and about 0.8 weight percent of the aluminum alloy. Thus, there exist a wide variety of combinations of the above metal alloying constituents that can be combined with aluminum to form aluminum alloys that are light in weight, high in strength, and ductile (i.e. having good elongation characteristics), as will be understood by those skilled in the art. Consequently, these alloys can be useful for making structural components that find broad application in the automotive and transportation industries.

In addition, in one aspect the alloying constituents can be divided into those having relatively low solution temperature ranges, such as silicon and copper, and those having relatively high solution temperatures, such as magnesium and manganese. In the particular case of the silicon, the range of solution temperatures for the silicon constituent can be quite large and somewhat variable, depending on the alloy, with low levels of silicon solutionizing occurring at temperatures below 440° C. to 470° C. and accelerating rates of silicon solutionizing taking place at temperatures above 470° C. to 490° C., Also depending on the alloy, a copper constituent can have a range of solution temperatures (generally between 475° C. and 495° C.) that is near to or even overlapped by the range of silicon solution temperatures in some embodiments, while the magnesium constituent and manganese constituent can generally have ranges of solution temperatures extending from 490° C. to 540° C.

As discussed above, the cast aluminum alloy components can be formed through a high pressure die casting (HPDC) process in which the molten metal is injected into a mold or die at high pressure and at high speed or gate velocity. While increasing production rates and lowering costs, the HPDC process typically results in the castings containing a higher content of dissolved or entrained gases than aluminum alloy components formed from low pressure die casting (LPDC), sand/SPM casting, or high vacuum die casting (HVDC) processes. U.S. Pat. No. 8,409,374 to Lumley et al., which is hereby incorporated by reference in its entirety herein, hypothesizes that the increased gas content can lead to the development of gas pore-based defects, such as surface blistering and dimensional instability, during the solution heat treatment that is generally applied to the parts after casting to improve their mechanical properties. It is this undesirable expansion of the gas pores that can result in excessive scrap rates if the castings remain at the higher solution temperatures for an extended period of time.

Consequently, it was suggested in Lumley that the time window for heat treating the HPDC aluminum alloy components to a desired [alloy] solution treatment temperature, including the heating time, should be much shorter than previously contemplated, and that the solution treatment state should be effectively non-isothermal (i.e. at a non-constant temperature). It was further suggested that the time spent by the castings in isothermal solution treatment (i.e. at a constant solution treatment temperature) was less important than the time spent within a specific temperature range and the final temperature reached prior to quenching.

While the concepts set forth in Lumley for avoiding high scrap rates by limiting the time spent by the castings within a specific temperature range can be observed in practice, it has been further determined by the present inventors that improved mechanical properties for the HDPC aluminum alloy parts, beyond those suggested by Lumley, can be achieved through a more controlled solutionizing heat treatment process that includes one or more substantially isothermal portions near or above one or more alloying metal solution temperatures.

For example, and without being bound to any particular theory, it is contemplated by the present inventors that the internal "pore-making" process that leads to the formation and expansion of the internal pores or gas bubbles within the castings begins with the silicon constituent of the aluminum alloy being taken into solid solution as the casting reaches or exceeds the silicon solution temperature. As the silicon is taken into solution, the size of the silicon particles appears to shrink as the overall number of silicon particles appears to grow, thereby allowing the entrained gases within the casting to migrate throughout the material. Eventually, however, the trend reverses as the smaller silicon particles grow together into larger particles that hinder or dam the migration of the gas. The entrapped gas then combines together into bubbles or pores that will continue to grow for as long as the casting is maintained at an elevated temperature. If left unchecked, the enlarged bubbles or pores near the surface can break through the surface as blisters, while the enlarged bubbles or pores internal to the casting can cause dimensional distortions.

Because the range of solution temperatures of the silicon constituent is substantially less than the range of the solution temperatures of at least one of the metal alloying constituents, such as magnesium and manganese, it is further theorized that the solutionizing heat treatment of the aluminum alloy that ultimately results in the desired improvements in mechanical properties may not begin until the castings are heated to the highest alloying metal solution temperature, well after the "pore-making" process has begun. By recognizing and taking into consideration the differences between the lower range of silicon solution temperatures and the higher range of alloying metal solution temperatures, the inventors have developed a method or process (and related systems) for heat treating cast aluminum alloy components that can be particularly advantageous over existing heat treatments for HPDC aluminum alloy parts that do not recognize this difference. For instance, the time spent by the castings above both the relatively low solution temperature of the silicon constituent and the relatively high solution temperature of the metal alloying constituent, prior to quenching, can be controlled to produce cast aluminum alloy components having superior mechanical properties at reduced scrap rates, and with the castings having a substantial reduction in dimensional distortions that would otherwise result from the formation of enlarged bubbles of entrapped gases.

As illustrated in FIG. 1, one embodiment of a method 10 for heat treating cast aluminum alloy components, or castings, generally involves cast components formed from an aluminum alloy having a known solution temperature for the silicon constituent, or at least a good approximation of the silicon solution temperature above which there is accelerated solutionizing of the silicon constituent, as well as a known or good approximation for the solution temperatures of the metal alloying constituents. The solution temperatures can be identified as discrete solution temperature values or, in all likelihood, as ranges of solution temperature values, as indicated above. In circumstances where the solution temperatures are defined as a known or approximate range, in one aspect the identified or "predetermined" solution temperature can be the boundary value for that range that is of most interest to the potential user. For instance, with a particular range of solution temperatures for the silicon constituent, the lower boundary for that range can be the value of greatest interest and may acceptably be identified as the predetermined silicon solution temperature 14. This can ensure that the solutionizing of the silicon constituent is substantially suppressed until after the casting temperature is intentionally raised above the predetermined silicon solution temperature 14.

Alternatively, if it is recognized that the upper boundary for the range of silicon solution temperatures in a particular aluminum alloy overlaps the range of a lower temperature metal alloying constituent, such as copper, the upper boundary may acceptably be identified as the predetermined silicon solution temperature 14. This can be advantageous by allowing at least a partial solutionizing of the copper constituent within a first heating stage while still restricting the accelerated solutionizing of the silicon constituent.

Conversely, the upper boundary for particular ranges of solution temperatures for the one for more metal alloying constituents will generally be the value of greatest interest, in which case the upper boundary for that range may acceptably be identified as the predetermined alloying metal solution temperature 18. For example, the range of solution temperatures for the copper alloying constituent of an exemplary aluminum alloy can range between about 485° C. to about 495° C., while the range of solution temperatures for the magnesium alloying constituent of the same alloy can range between about 510° C. to about 530° C. Thus, in one aspect the predetermined alloying metal solution temperature 18 may acceptably be identified as 530° C. to ensure that all of the metal alloying components reach their solution temperatures.

It is contemplated that the silicon constituent of some aluminum alloys may begin to slowly solutionize at about 420° C., but at a reduced rate that does not quickly lead to the enlarged silicon particles that impede the movement of the entrained gases within the casting. The solutionizing rate of the silicon constituent can then rapidly increase at casting temperatures higher than 440° C., such as between 470° C. and 490° C., so that a substantial portion of the silicon constituent will enter into solid solution within a short period of time, once the casting enters this range of casting temperatures, to fully initiate the process of silicon particle size reduction and subsequent enlargement described above. For reasons set forth below, the predetermined silicon solution temperature 14 will generally be set at a casting temperature slightly below or within the range of temperatures associated with the accelerated solutionizing rates of the silicon constituent (for example, 440° C. to 470° C.), yet which may still be above the casting temperature associated with the onset of solutionizing of the silicon constituent at the reduced rate.

It is also appreciated, however, that the metallurgical arts do not always lend themselves to precision values or clear-cut determinations in practice, so that even the ranges of temperature values for one or more of the solution temperatures may not be known with high accuracy. Thus, in other aspects the predetermined solution temperature can be an inter mediate value, such as an average or a median value, for that range of solution temperature values. In addition, it is contemplated that the predetermined solution temperatures 14, 18 of a particular aluminum alloy may be identified, for example, in a laboratory, through previous experience, or through ongoing quality control and evaluation during a manufacturing cycle, with subsequent adjustments of the predetermined solution temperatures 14, 18 to further refine the heat treatment method for a particular aluminum alloy, or for a particular type of casting, or both.

In embodiments when the aluminum alloy has two or more metal alloying constituents in significant amounts, such as both copper and magnesium, the combination of metal alloying constituents can often result in a range of combined alloying metal solution temperatures that is different from the range of alloying metal solution temperatures for each metal alloying constituent when taken separately. For example, in one embodiment the range of solution temperatures for the alloying constituents of an aluminum alloy with copper and magnesium alloying constituents can range between about 490° C. to about 515° C., and the predetermined alloying metal solution temperature 18 can be identified as 515° C. For other cases in which the ranges of casting temperatures at which the various metal alloying constituents are taken into solid solution remain distinct and different, in one aspect the single greatest value in the ranges of alloying metal solution temperatures can be identified as the predetermined alloying metal solution temperature 18. Alternatively, an intermediate value in the ranges of alloying metal solution temperatures can also be used, as described above.

It will thus be appreciated by one of skill in the art that the values or ranges for both the silicon solution temperature and the alloying metal solution temperature can vary depending on the composition of the aluminum alloy, including but not limited to the presence of the different varying metal constituents and their weight percentages. Accordingly, the heat treatment method 10 of the present disclosure can include a customized casting temperature profile 12 for each alloy that is based on the principle that the silicon constituent of the aluminum alloy will transition into solid solution at a lower temperature, and therefore sooner, than the metal alloying constituents.

With continued reference to FIG. 1, the heat treatment method 10 generally includes three separate heating segments or stages, namely a first heating stage 20, a second heating stage 30, and a quenching stage 40. The first heating stage 20 comprises a first period of time (t1) 24 from when the one or more castings enter the furnace and are heated from an initial casting temperature 21 to a first casting temperature 25 that is near to the predetermined silicon solution temperature 14 (above which there is substantial or accelerated solutionizing of the silicon constituent), yet without reaching or exceeding the predetermined silicon solution temperature 14. In one aspect, for example, the first casting temperature 25 can be between about 5° C. and about 10° C. below the predetermined silicon solution temperature 14 in order to ensure that the silicon constituent does not reach this temperature in any portion of the casting, yet is still close enough to the predetermined silicon solution temperature 14 that the casting can be quickly heated, in a matter of seconds, to a temperature that exceeds the predetermined silicon solution temperature 14 upon entry into the second heating stage 30. In other aspects, such as when the silicon solution temperature 14 is precisely known and the heat treatment process 10 can be tightly controlled, the first casting temperature 25 can be between 2° C. and 5° C. below the predetermined silicon solution temperature 14. In addition, while the temperature differential between the first casting temperature 25 and the predetermined silicon solution temperature 14 can initially be about 10° C., it is to be appreciated that other values for the temperature differential, whether greater than or less than 10° C., are also possible and considered to fall within aspects of the scope of the present disclosure.

It will be appreciated that both the time duration (t1) 24 and the heating rate 22 (or alternative heating rate 23) of the castings in the first heating stage 20 can vary substantially between different embodiments of the heat treatment method 10. For reference purposes, the rise/run of the first heating rate 22 is defined as ° C./min, and can be applied as an instantaneous heating rate or as an average heating rate during a specified period of time, such as, for example, the entire first heating stage 20 or merely a portion of the first heating stage 20. Factors that affect the duration (t1) and/or the first heating rate 22 can include the type and configuration of the furnace, the initial temperature 21 of the castings when the castings first enter the furnace, the thickness and/or the surface area exposure of the castings, the number of castings in a tray of castings, and the like.

For instance, in some embodiments the castings may be quite thick, such as the castings for an engine block, and it is generally preferable for all of the material of the thick castings to reach the first casting temperature 25 prior to entering the second heating stage 30. In other embodiments a batch of castings may be loaded into a tray or rack of castings in a configuration that is dense enough to affect the flow of thermal fluids to the individual castings, and it is likewise preferable for all of the castings within the batch to reach the first casting temperature 25 prior to entering the second heating stage 30. Greater uniformity in reaching the first casting temperature 25 for all portions of the castings, or for all of the castings loaded within a tray or rack, may be achieved by allowing the castings to soak at the first casting temperature 25 for a few minutes 2-5 minutes or a more extended time period) toward the end of the first heating stage 20 to provide ample time for the heat to become evenly distributed throughout the castings. Moreover, by ensuring that the first casting temperature 25 is sufficiently below the predetermined silicon solution temperature 14, this uniformity in treatment can be accomplished without concern for substantial solutionizing of the silicon constituent.

As shown by casting temperature line 12 in FIG. 1, in one aspect the castings may be heated at a substantially constant first heating rate 22 throughout a majority portion of the first heating stage 20, followed by a gradual tapering of the rate of heating toward the end of the first heating stage as the castings approach the intended first casting temperature 25. This technique can provide better control of the heat treatment process and ensure that the temperature of the castings does not inadvertently overshoot the first casting temperature 25 and encroach or reach the predetermined silicon solution temperature 14 while the castings remain in the first heating stage 20, and thereby prematurely trigger the pore-making process described above.

Alternatively, as shown by alternative first stage casting temperature line 13, in other aspects the first heating stage of the furnace can be maintained at a relatively constant first stage temperature that is equal to or above the first casting temperature 25. In this way the flow of heat into the castings, and thus the first heating rate 23, continuously decreases throughout the first heating stage 20 as the castings slowly approach a state of thermal equilibrium with the first stage temperature. In embodiments where first stage temperature is greater than the first casting temperature 25, the movement of the castings through the furnace can be timed so that the castings reach the first casting temperature 25 and exit the first heating stage 20 prior to reaching thermal equilibrium with the first stage temperature. In embodiments where the first stage temperature is equal to the first casting temperature 25, the time duration (t1) 24 of the castings within the first heating stage 20 can be extended so that the castings can reach a thermal equilibrium at the first casting temperature 25 prior to exiting the first heating stage 20.

In yet other embodiments the castings may be thin-walled structures that are spaced apart with a greater proportion of exposed surface area that readily receives and distributes the applied heat, so that each casting reaches thermal equilibrium at the first casting temperature 25 in a much shorter period of time, in which case the thermal soaking period may be reduce or eliminated.

Thus, upon review of both casting temperature line 12 and alternative casting temperature line 13 shown in FIG. 1, it will be appreciated that the particular path for reaching the first casting temperature 25 can be less important than the value of the first casting temperature 25 relative to the predetermined silicon solution temperature 14, or the amount of time that the castings have to soak within the first heating stage 20 in order to reach a uniform temperature.

Accordingly, in one aspect the first heating stage can be maintained at a first stage temperature that is less than 10° C. below the predetermined silicon solution temperature 14. In another aspect the first heating stage 10 can be maintained at a first stage temperature that is greater than the predetermined silicon solution temperature 14, so as to provide an increase in the first heating rate 22 throughout the first heating stage 20 with a corresponding decrease in the time duration (t1) 24 of the first heating stage, and which can further include accurate control of the movement of the castings through the first heating stage 20 to ensure that the castings exit the first heating stage 20 prior to reaching the predetermined silicon solution temperature 14.

Upon reaching the first casting temperature 25 at the end of the first heating stage 20, the castings can then transition or move into the second heating stage 30 of the heat treatment process 10 that generally comprises a second period of time (t2) 34 extending from the entrance of the castings into the second heating stage 30 until their exit and movement into the quench stage 40. Upon entry into the second heating stage 30, the heat input into the castings can be immediately or sharply increased to quickly raise the temperature of the castings from the first casting temperature 25 to a second casting temperature 35 that is greater than or substantially equal to the predetermined alloying metal solution temperature 18. In one aspect the castings can then be maintained at the second casting temperature 35 for the remainder of the time period (t2) 34 of the second heating stage 30 in a substantially isothermal (i.e. constant temperature) portion 37 of the process 10. Depending on the time taken to heat the castings from the first casting temperature 25 to the second casting temperature 35 after entry into the second heating stage 30, the substantially isothermal portion 37 of the heat treatment process 10 at the second casting temperature 35 can preferably range from about 10 minutes to about 20 minutes. Nevertheless, substantially isothermal portions 37 that are less than 10 minutes in duration, such as between 5 minutes and 2 minutes in duration, are also possible and considered to fall within the scope of the present disclosure.

In yet another aspect of the present disclosure (not shown) the castings may be quenched promptly after reaching the second casting temperature 35. Accordingly, in this embodiment the only isothermal portion of the casting temperature may be the heat soak period at the first casting temperature 25 near the end of the first heating stage 20 and prior to entering the second heating stage 30, so that all of the castings or portions of the castings reach the first casting temperature prior to being exposed to the increased heat input within the second heating stage.

In one aspect the second casting temperature 35 can be between about 5° C. and 10° C. above the predetermined solution temperature 18 of the metal alloying constituent, in order to ensure that the metal alloying constituent in all portions of the casting reaches or exceeds the alloying metal solution temperature and enters into solid solution, but without excessively exceeding the alloying metal solution temperature in ways that could lead to detrimental side effects. In other aspects, such as when the alloying metal solution temperature is precisely known and the heat treatment process 10 can be tightly controlled, the second casting temperature 35 can be 5° C. or less above the predetermined solution temperature 18 of the metal alloying constituent.

As illustrated in FIG. 1, the heating of the castings in the second heating stage 30 can involve an initial second heating rate 32, or rate of heat input, that is sharply increased over the heating rate that was applied to the castings in the first heating stage 20 immediately prior to entering second heating stage 30. This can result in a step increase in the temperatures of the castings to the second casting temperature 35 within a shortened period of time, with the temperature 12 of the castings reaching the predetermined silicon solution temperature 14 within seconds of entering the second heating stage 30. For example, while it can typically take 3 to 5 minutes at the initial or second heating rate 32 for the castings to reach the predetermined alloying metal solution temperature 18, the temperature of the castings can nevertheless reach and exceed the predetermined silicon solution temperature 14 shortly after entering the second heating stage 30. Indeed, and especially in cases when the first casting temperature 25 at the end of the first heating stage 20 is within a few degrees of the predetermined silicon solution temperature 14, the temperature of the castings can reach and exceed the predetermined silicon solution temperature 14 within 60 seconds or less of entering the second heating stage 30. Thus, in one aspect, the time that the castings spend above the predetermined silicon solution temperature 14 can be substantially equal to the time (t2) spent within the second heating stage 30, which feature can be used to simplify subsequent calculations.

In one embodiment the second heating stage 30 of the furnace can be maintained at a substantially constant second stage temperature that is greater than the first stage temperature, thereby increasing the rate of heat input into the castings during at least the first portion of the second heating stage 30. Thus, in one aspect the additional heat input needed to quickly raise the temperature of the castings to the second casting temperature 35 can be provided by an additional heating apparatus, such as directed heaters or high flow hot air nozzles, that can direct additional heat onto the castings and provide a boost to the initial second heating rate 32. In this way, for example, the castings can be heated to within 5° C. of the second casting temperature within 5 minutes or less of entering the second stage. Moreover, the additional heating apparatus can be configured to raise the temperature of the castings to the second casting temperature 35 in a shortened period of time without substantially raising the overall second stage temperature in the second heating stage portion of the furnace.

Once the castings reach the second casting temperature 35 that is associated with the substantially isothermal portion 37 of the process 10, the second stage temperature can prevent the flow of heat away from the castings for the remainder of the time period (t2) 34 of the second heating stage 30. In one aspect the second stage temperature can be substantially equal to the second casting temperature 35, while in other aspects the second stage temperature can be marginally higher than the second casting temperature 35 so that the temperature of the castings continues to rise slightly during the remainder of the second heater stage, but typically only a small amount as the time remaining in the second heating stage is relatively short. In one embodiment the second stage temperature can be less than or about 10° C. above the predetermined alloying metal solution temperature 18 at which the at least one metal alloying constituent rapidly enters into solid solution.

In comparing the period of time (t3) 36 the castings spend at or above the predetermined solution temperature 18 of the metal alloying constituent with the overall time duration (t2) 34 of the second heating stage 30, as measured from entering the second heating stage 30 to entering the quench stage 40, the (t3)/(t2) timing ratio of the castings at the alloying metal solution temperature 18 can be 50% or greater. This timing ratio can also be known as the time-in-treatment ratio. As will be appreciated by those skilled in the art, the time-in-treatment ratio can be a good approximation of the actual percentage of time that the castings spend in the solutionizing heat treatment at or above the alloying metal solution temperature at which the metal alloying constituent rapidly enters into solid solution, in addition to being at or above the silicon solution temperature at which the silicon constituent rapidly enters into solid solution. It will also be appreciated that the time-in-treatment ratio provided by the present disclosure can be substantially increased over solution heat treatment methods for HPDC castings currently known and practiced in the art.

Indeed, depending on the temperature differentials between the predetermined silicon solution temperature 14 and the predetermined alloying metal solution temperature 18 and between the first casting temperature 25 and the predetermined silicon solution temperature 14, as well as the configuration of the furnace, it is contemplated that in some embodiments the (t3)/(t2) time-in-treatment ratio of the castings at or above the predetermined alloying metal solution temperature 18 can be greater than 60%, greater than 70%, or even 80% or greater. For example, if it has been determined that the (t2) value for a particular alloy is limited to 18 minutes in order to avoid the manifestation of blistering and/or dimensional distortion on a high percentage of the castings, a (t3)/(t2) time-in-treatment ratio of 75% can ensure that the castings are maintained at or above the predetermined alloying metal solution temperature for about 13.5 minutes. In this way the castings can obtain a substantial increase in the beneficial affects of an alloying metal solutionizing heat treatment while avoiding the harmful effects of the pore-based defects by limiting the time spent at or above the silicon solution temperature.

It will thus be appreciated that heating the castings in the first heating stage 20 to a first casting temperature 25 that is near to the predetermined silicon solution temperature 14, yet without reaching or exceeding the predetermined silicon solution temperature 14, can be advantageous for both reducing the heating requirements in the second heating stage 30, and for reducing the time needed to reach the predetermined alloying metal solution temperature 18 as the castings are heated to the second casting temperature 35 in the second heating stage 30.

Furthermore, and as discussed above, maintaining the castings at the first casting temperature 25 for an extended period of time can advantageously ensure that all the castings or portions of the castings reach the first casting temperature 25 prior to being exposed to the increased heat input within the second heating stage 30. In this way a thermal equilibrium point can be established at a midpoint within the heat treatment process that can operate to improve the uniformity and consistency of the finished castings. In addition, since there is no limitation in the time duration of the first heating stage 20 as there is with the second heating stage 30, the duration 24 of the first heating stage 20 can be extended as long as necessary (to 15 minutes to 20 minutes or more, for example) to establish substantial thermal equilibrium within the castings or a batch of castings.

Upon reaching the end of the second heating stage 30, the castings can then transition or move into the quench stage 40 of the heat treatment process 10 in which the castings are quickly cooled from the second casting temperature 35 to a quenched temperature 45 that is generally less than 250° C. but still well above ambient temperature. The quench stage 40 generally comprises a liquid spray cooling system, a forced air or gas cooling system, a liquid immersion cooling system, or combinations of the above. During the quench stage 40 the castings can be cooled at a cooling rate 42 for a time period (t4) 44 that generally ranges from one to about five minutes. After completion of the quench stage 40, the castings can be removed to ambience and allowed to cool and naturally age for a T4 temper, or to a separate temperature controlled chamber (not shown but known to one of skill in the art) for artificial aging at an elevated temperature for a predetermined period of time to achieve a T6 temper. As will be appreciated by one of skill in the art, other quenching and aging protocols are also possible and considered to fall within the scope of the present disclosure.

Also visible in FIG. 1, the castings can pass through a first transition zone 29 when transitioning between the first heating stage 20 and the second heating stage 30, and then again through a second transition zone 39 between the second heating stage 30 and the quench stage 40. The second transition zone 39 will typically comprise the physical movement of the castings from within the furnace to a quench station that is located outside the furnace, such as through a discharge door at the outlet end of the furnace. However, the first transition zone 29 between the first heating stage 20 and the second heating stage 30 can comprise either movement through a physical barrier or an increase in the heating rate, typically depending on the type of furnace used to perform the heat treatment. For example, a process furnace that continuously moves the castings through a heated interior volume on a conveyor system may include an interior door that defines the boundary between the two stages. Alternatively, a batch furnace that heats the castings in place can include additional heaters, high flow hot air nozzles, or similar heating apparatus that can become active to define the first transition zone to increase the rate of heating and quickly raise the temperature 12 of the castings from first casting temperature 25 to the second casting temperature 35.

Figure 2:
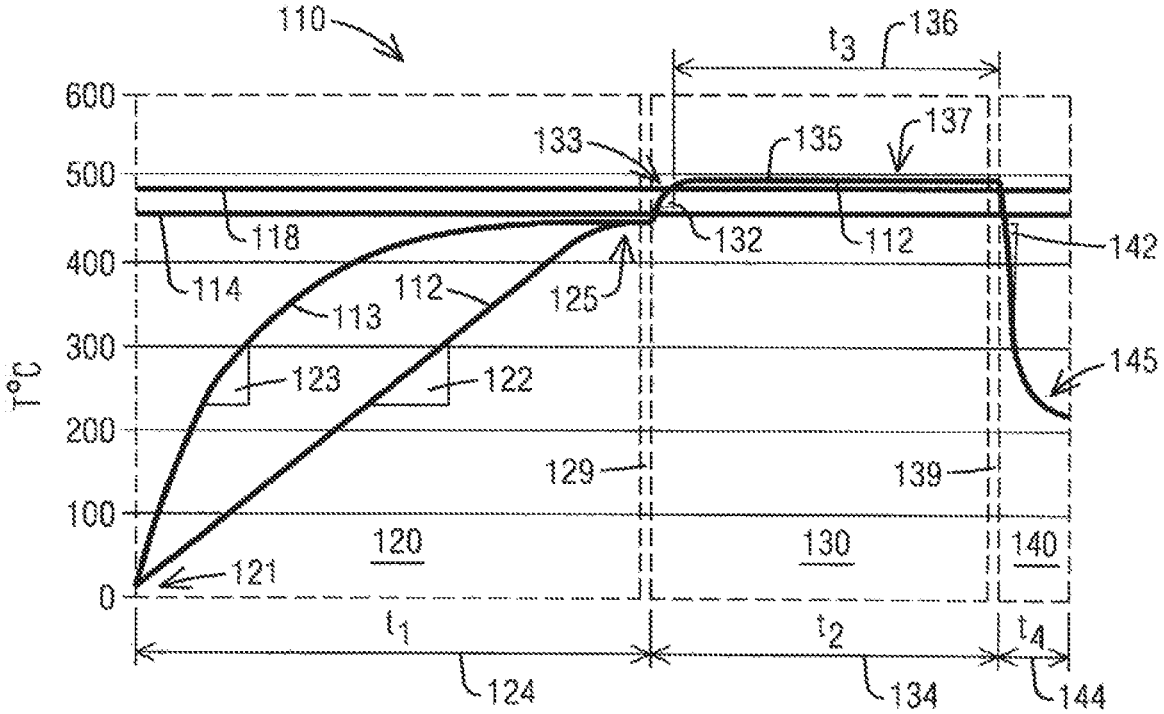
FIG. 2 is another graph of the temperature experienced by an aluminum alloy casting during a heat treatment process, in accordance with another representative embodiment of the present disclosure.
Figure 3:
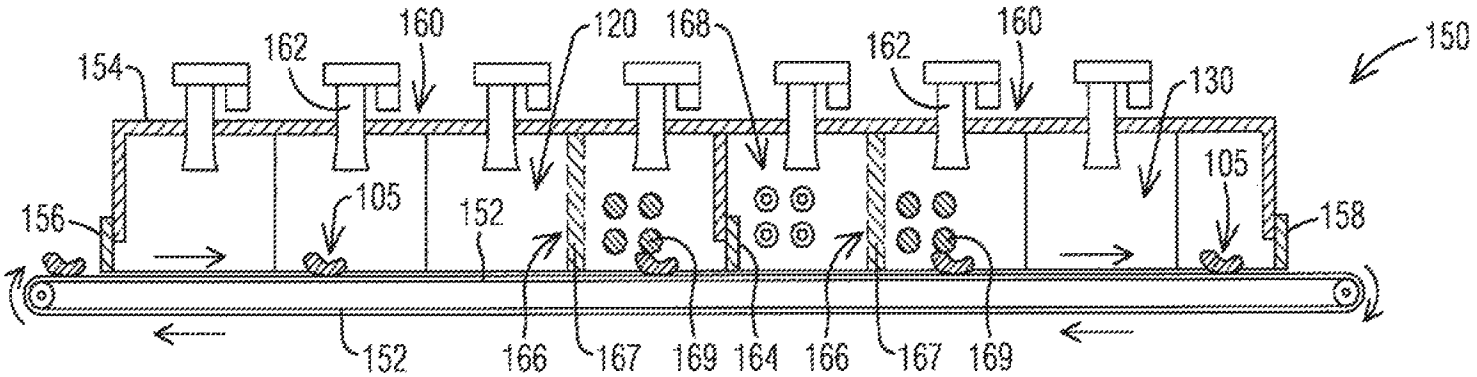
FIG. 3 is a schematic diagram of a system for implementing the heat treatment process of FIG. 2, in accordance with yet another representative embodiment of the present disclosure.
Figure 4:
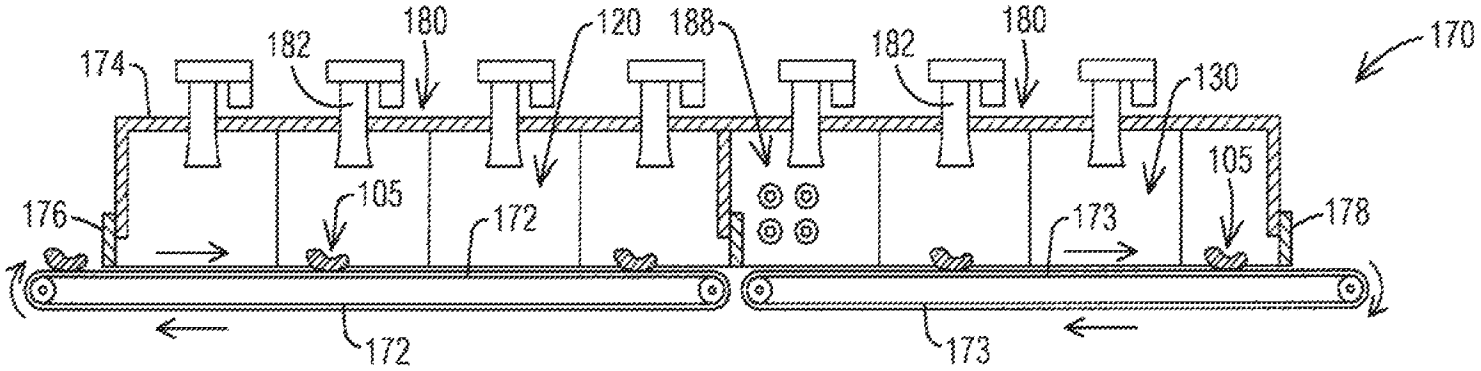
FIG. 4 is a schematic diagram of a system for implementing the heat treatment process of FIG. 2, in accordance with another representative embodiment of the present disclosure.

FIG. 2 illustrates another representative embodiment of the heat treatment process 110 in which a plurality of HPDC aluminum alloy components are carried through a continuous process furnace on one or more conveyor systems, such as through one of the two continuous process furnaces 150, 170 that are schematically illustrated in FIGS. 3 and 4.

As shown in FIG. 3, one embodiment of a process furnace 150, in accordance with the present disclosure, can generally comprise an endless conveyor chain 152 (i.e. a parallel synchronized pair of chains) running through an insulated enclosure 154, with an intake door 156 at an inlet end and a discharge door 158 at an outlet end. The furnace 150 can further include a number of heating cells 160 aligned in series along the length of the furnace 150, with each heating cell 160 including a heater assembly 162 extending into the cell (for example, extending downward through the ceiling of the enclosure 154) and comprising, for instance, a heater unit and a motor driven blower that drives the heated air downward into the enclosure 154 to impinge on the castings 105 riding slowing through the furnace on trays that straddle the distance between the individual chains in the conveyor chain 152. Although the process furnace 150 shows seven heating cells 160 arranged along the length of the furnace with each heating cell 160 having its own blower-based heater assembly 162, it will be appreciated that FIG. 3 is a mere schematic representation of one possible configuration of a process furnace 150 or system for implementing the heat treatment method 110 of FIG. 2, and that a wide variety of heating cell numbers and arrangements, as well as various different types of heater assemblies and technologies, are also possible and considered to fall within the scope of the present disclosure.

In one aspect the process furnace 150 can include an internal barrier with a gate or intermediate door 164 that divides the interior of the insulated enclosure 154 into a first heating stage 120 and a second heating stage 130 that coincide with the first heating stage 120 and second heating stage 130 depicted in FIG. 2. As the single conveyor chain 152 passes through both stages to carry the castings 105 through the furnace 150 at a constant speed, it will be appreciated that the speed of the conveyor chain 152, the total length of the furnace enclosure 154, and the position of the intermediate door 164 along the length of the enclosure can deter mine the time duration (t1) 124 of the first heating stage 120 and the time duration (t2) 134 of the second heating stage 130. In addition, the time duration (t2) 134 of the second heating stage 130 is generally limited to 25 minutes to 30 minutes or less, and preferably 20 minutes or less, to ensure that the castings 105 exit the furnace 150 before the development of any pore-based defects. As a result, the heat output produced by the heating cells 160 in the first heating stage 120 can then be adjusted to continuously heat the castings 105 at a desired first heating rate 122 so that the temperature 112 of the castings 105 reaches the first casting temperature 125 prior to or substantially simultaneous with the castings 105 reaching the intermediate door 164.

In another aspect the temperature of the first heating stage 120 can be maintained at the first casting temperature 125 and the time duration Op 124 can be extended until thermal equilibrium is gradually established between castings 105 and the heated air in the first heating stage 120. This can create an alternative casting temperature line 113 defined by an alternative heating rate 123 that continuously decreases throughout the first heating stage 120 as the castings slowly approach a state of thermal equilibrium with the first stage temperature, similar to that shown in FIG. 1 above. The temperature of the second heating stage 130 can likewise be maintained at the second casting temperature 135, but with the additional heat input at the beginning of the second heating stage 130 to quickly bring the castings into thermal equilibrium between castings 105 and the heated air in the second heating stage 130.

In the representative embodiments of the solution heat treatment method 110 illustrated in FIG. 2 and the solution heat treating system 150 illustrated in FIG. 3, the predetermined silicon solution temperature 114 for a particular aluminum alloy that forms the castings 105 can be about 445° C. and the predetermined alloying metal solution temperature 118 can be about 485° C. Accordingly, the first casting temperature 125 can be about 440° C., the second casting temperature 135 can be about 490° C., and the initial temperature 121 of the castings 105 as the castings enter the furnace 150 through the intake door 156 can be about 20° C. This results in a temperature rise in the first heating stage of about 420° C. and a temperature rise in the second heating stage of about 50° C. For illustrative purposes, the time duration (t2) 134 of the second heating stage 130 can be set to 18 minutes.

The representative process furnace 150 in FIG. 3 includes seven heating cells 160, with the intermediate door 164 located between the forth and fifth heating cells. With the speed of the conveyor chain being set at a constant rate so that the castings 105 traverse the second heating stage from the intermediate door 164 to the discharge door 158 in 18 minutes, the time duration (t1) 124 for the castings to transition the first heating stage 120 through the first four heating cells 160 becomes about 24 minutes, based on calculations understood by those of skill in the art. This can lead to an average first heating rate 122 of about 20° C./min during a majority portion of the first heating stage 120, with the rate of heating then tapering off substantially as the castings 105 approach the first casting temperature 125 of 440° C., as indicated in FIG. 2.

Once the castings 105 move through the first transition zone 129, i.e. the intermediate door 164, to enter the second heating stage 130, an initial second stage heating rate 132 of about 25° C./min can be applied to the castings to quickly raise their temperatures to the second casting temperature 135 of 490° C. in about 3 minutes, with some tapering in the heating rate 132 as the castings approach the second casting temperature 135. The castings can then be maintained at the second casting temperature 135, in the substantially isothermal portion 137 of the process 110, for the remaining 15 minutes in the second heating stage 30 until the castings reach the discharge door 158 and move through the second transition zone 139 to exit the furnace 150 and enter the quenching stage 140 (with the quenching station not being shown in FIG. 3 but known to one of skill in the art). Moreover, in the representative embodiments of FIGS. 2-3, the (t3)/(t2) time-in-treatment ratio of the castings 105 at or above the predetermined alloying metal solution temperature 118, as defined above, can be about (16 minutes/18 minutes), or about 89%, since the castings reach the predetermined alloying metal solution temperature 118 prior to the second casting temperature 135.

After passing through the second transition zone 139 and entering the quench stage 140, the castings 105 can be cooled from the second casting temperature 135 of 490° C. to a quench temperature 145 that is less than 250° C., in less than three minutes, and at a cooling rate that can be greater than 80° C./min.

Also visible in FIG. 3, in one aspect the position of the intermediate door 164 along the length of the furnace enclosure 154 can be changed to better accommodate the desired casting temperature profile for a particular aluminum alloy casting. If, for example, a blank space 166 is provided between each of the heating cells 160 in the center of furnace enclosure 154 and filled with an insulated spacer 167 when not in use, the intermediate door 164 can then be moved upstream or downstream as desired to reassign the adjacent heating cells into the second heating stage 130 or into the first heating stage 120, respectively. This feature can be advantageous over furnaces having an intermediate door in a fixed position by providing the user with an additional variable beyond the speed of the conveyor chain 152 and the output of the heater assemblies 162 for optimizing the (t3)/(t2) time ratio in the second heating stage.

Furthermore, it will be appreciated that the output of the heater assembly in the first heating cell of the second heating stage 130 may not be sufficient to raise the initial or second heating rate 132 to the desired value. In this case one or more additional heating apparatus 168, such as an additional heater or hot air nozzle, can be added to the affected heating cell to direct additional heat onto the castings 105 and provide a boost in the initial or second heating rate 132 that will raise the temperature of the castings to the second casting temperature 135 in a shortened period of time. For furnaces 150 having an adjustable intermediate door 164, empty supporting fixtures filled with insulating spacers 169 can also be provided at each additional optional location, so that the additional heating apparatus 168 can be repositionable along with the intermediate door 164.

The process furnace 170 schematically illustrated in FIG. 4 illustrates another option for accommodating a desired casting temperature profile for a particular HPDC aluminum alloy casting. Similar to the previous embodiment, the process furnace 170 generally includes an insulated enclosure 174 with an intake door 176 at an inlet end, an intermediate door 184 that separates the enclosure into a first heating stage 120 and a second heating stage 130, and a discharge door 178 at an outlet end. The furnace 150 also includes a number of heating cells 180 aligned in series along the length of the furnace 170, with each heating cell 180 comprising a heater assembly 182 extending downward through the ceiling to direct heated air downward into the enclosure 154 to impinge on the castings 105 below that are riding slowing through the furnace on a conveyor system. An additional heating apparatus 188 can also be added immediately downstream of the intermediate door 184 to provide a boost in the initial or second heating rate 132 of the second heating stage 130.

In this embodiment of the process furnace 170, however, the position of the intermediate door 184 along the length of the enclosure 154 can be fixed and the conveyor system can comprise conveyor chains 172, 173 (i.e. parallel synchronized pairs of chains) having independently controllable operating speeds. The two independently controllable conveyor chains 172, 173 can provide the user with the capability of independently configuring the time duration (t1) of the first heating stage and the time duration (t2) of the second heating stage, which in turn can allow for optimization of both the first heating rate 122 and the (t3)/(t2) time-in-treatment ratio in the second heating stage 130. In one aspect the two conveyor chains 172, 173 can meet together at the first transition zone 129 (i.e. the intermediate door 184), as illustrated in FIG. 4, while in other aspects the conveyor chains can meet together at another location within the furnace enclosure 174, such as at a location within the second heating stage 130 and downstream of the intermediate door 184 (not shown).

Figure 5:
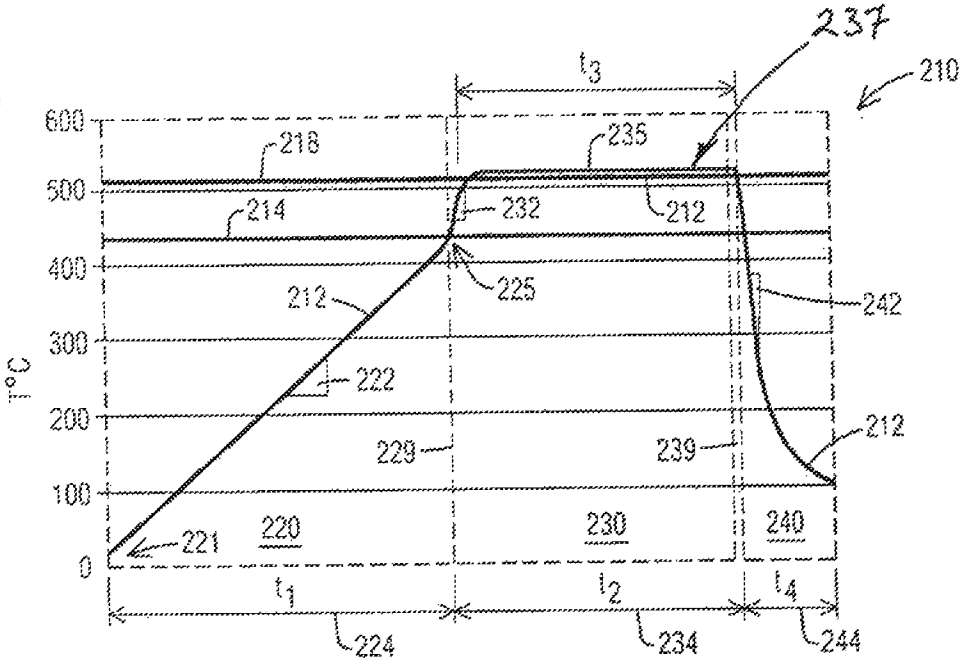
FIG. 5 is a another graph of the temperature experienced by an aluminum alloy casting during a heat treatment process, in accordance with yet another representative embodiment of the present disclosure.
Figure 6:
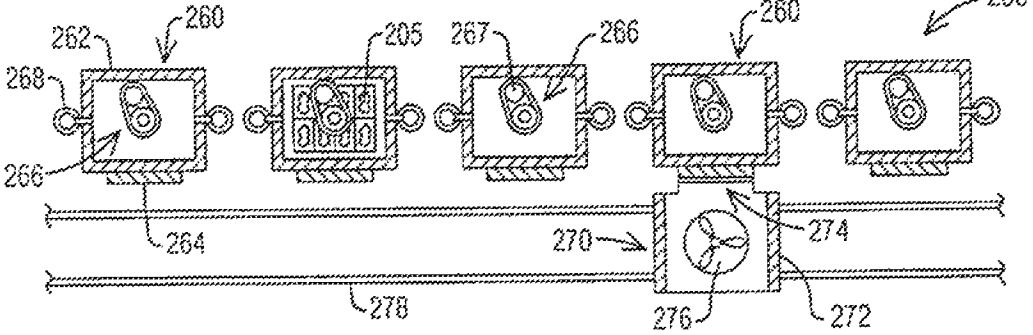
FIG. 6 is a schematic diagram of a system for implementing the heat treatment process of FIG. 5, in accordance with another representative embodiment of the present disclosure.

FIGS. 5 and 6 together illustrate additional representative embodiments of the solution heat treatment method 210 (FIG. 5) and the solution heat treating system 250 (FIG. 6) that have been adapted for a batch heat treatment process. Similar to the example provided above, the solution heat treatment method 210 can include a desired casting temperature profile for a plurality of HDPC cast aluminum alloy components 205 having a silicon solution temperature 214 of about 440° C. and a alloying metal solution temperature 218 of about 510° C. Accordingly, the first casting temperature 225 can be about 435° C., the second casting temperature 235 can be about 515° C., and the initial temperature 221 of the castings 205 at the beginning of the solution heat treatment process can be about 20° C. This results in a temperature rise in the first heating stage of about 415° C. and a temperature rise in the second heating stage of about 75° C. For illustrative purposes, the time duration (t2) 234 of the second heating stage 230 can be set to 21 minutes.

The solution heat treating system 250 illustrated in the plan view of FIG. 6, can comprise a plurality of batch-type heat treating furnaces 260 aligned side-by-side. Each furnace 260 can include an insulated enclosure 262 with an access door 264 on one side, and with all the access doors 264 facing the same direction. Each of the furnaces 260 can also include at least one primary heater assembly 266 extending downward through the ceiling of the enclosure 264 and comprising, for example, a heater unit and a motor driven blower that drives the heated air downward into the enclosure 262 that is typically sized to receive a plurality of castings 205 that have been loaded onto a tray or rack in spaced-apart and/or stacked relationships, so that the heated air can be substantially uniformly applied to each casting. In one aspect the primary heater assembly 266 can be configured to provide a variable heat output, such as with a variable frequency motor drive 267 that can increase the flow of heated air into the enclosure 262. In another aspect the heat treating furnaces 260 can be provided with one or more additional secondary heaters 268, such as an additional heater or high flow hot air nozzle, to provide a boost to the initial or second heating rate 232 that will raise the temperature of the castings 205 to the second casting temperature 235 in a shortened period of time.

Also shown in FIG. 6, the solution heat treating system 250 can further include a movable quench station 270 that translates back and forth in front of the access doors 264 (i.e. the second transition zone 239) in each of the furnaces 260 to receive and immediately quench the rack of heated castings after the castings are withdrawn from the furnaces 260. The quench station generally includes an enclosure 272 with at least one opening 274 directed toward the furnaces 260 for receiving the rack of castings, and which enclosure also supports a cooling system 276, such as the liquid spray cooling system or forced air or gas cooling system discussed above. In one aspect the movable quench station 270 can be supported on a wheeled carriage which can be moved between the various furnaces on rails 278. As will be appreciated by one of skill in the art, the movement of the quenching station 270 can be synchronized with the heat treatment cycles taking place in each batch-type furnaces 260 so that the quench station is prepared to receive the treated castings as soon each batch of castings reaches the end of its second heating stage 230.

With the batch-type heat treating furnaces 260 of the solution heat treating system 250 of FIG. 6, the first transition 229 between the first heating stage 220 and the second heating stage 230 can be a "virtual" transition comprising an increase in the rate of heating the castings from a first heating rate 222 in the first heating stage to an initial or second heating rate 232 in the second heating stage 230. In one aspect the increase in the rate of heating can be achieved through an increased heat output from the primary heater assembly 266, such as with in increase in the speed of the variable frequency motor drive 267, or by the temporary activation of the one or more additional secondary heaters 268, as described above.

Despite the possible inefficiencies of batch-type heat treating resulting from the repeated heat cycling within the furnace chamber, one advantage provided by the heat treating furnaces 260 of FIG. 6 is that the time duration (t1) 224 of the first heating stage 220 can be defined by the first heating rate 222, while the time duration (t2) 233 of the second heating stage 230 can be defined by the opening of the access door 264 and removal of the castings 205 from the furnace enclosure 262. For the casting temperature profile 212 illustrated in FIG. 5, for example, the time duration (t1) 224 of the first heating stage 220 can be custom defined by the user to achieve the desired first heating stage temperature rise of about 415° C. Moreover, with the time duration (t2) 234 of the second heating stage 230 being set to 21 minutes to avoid the development of any pore-based defects, the initial or second heating rate 232 in the second heating stage 230 may then be set to about 30° C./min to achieve the second heating stage temperature rise of 75° C. in less than three minutes. This can lead to a substantially isothermal portion 237 of the process 210 at the second casting temperature 235 of about 18 minutes, and a (t3)/(t2) time-in-treatment ratio of the castings 205 at or above the predetermined alloying metal solution temperature 214, as defined above, of about (19 minutes/21 minutes), or about 90%.

FIGS. 7A-7D are schematic diagrams of a representative transfer apparatus 320 that may be used for moving a casting 305 between two primary conveyor chains 312, 316 (i.e. two synchronized pairs of chains), similar to the two conveyor chains illustrated in FIG. 4. The transfer apparatus 320 generally includes a third transfer conveyor chain (i.e. also a synchronized pair of chains) that is positioned in between the individual chains of the primary conveyor chains while extending across the gap between the adjacent ends of the first primary conveyor chain 312 and the second primary conveyor chain 316. As shown in the drawings, the adjacent ends of the primary conveyor chains 312, 316 can be positioned on either side of a intermediate door 314 that divides the interior of a furnace enclosure into a first heating stage and a second heating stage (not shown). Furthermore, and as discussed above, the primary conveyor chains 312, 316 can be independently controllable with individually configurable operating speeds.

In the inactive position illustrated in FIG. 7A, the top surfaces 324 of the transfer conveyor chain 322 can be positioned below the top surfaces of the primary conveyor chain 312, so that a tray which spans the primary conveyor chain 312 and supports the casting 305 thereon is able to be carried over the first end 321 of the transfer apparatus 320 that is located within the first heating stage. The primary conveyor chain 312 can then be stopped and the transfer conveyor chain 322 raised by rotating the angled support links 331, 335 at both ends 321, 325 of the transfer conveyor chain 322, as shown in FIG. 7B. In one aspect the support links 331, 335 can be rotated by about 18 degrees to that the entire transfer conveyor chain 322 is raised by about ¾ inch in a substantially uniform manner. This allows the top surfaces 324 of the transfer conveyor chain 322 to engage the bottom of the tray and lift the casting 305 off the first primary conveyor chain 312. Simultaneous with the raising of the transfer conveyor chain 322, the intermediate door 314 that divides the interior of the furnace enclosure can also be raised in preparation for transferring the casting 305 between the heating stages.

As shown in FIG. 7C, the transfer conveyor chain 322 can then be activated to move the casting 305 through the opening and into the second heating stage. The transfer conveyor chain 322 may be operated by an articulated linkage 337 located at one end of the transfer apparatus 320 that can serve to rotate the support links 331, 335 to raise the transfer conveyor chain 322 and/or rotate the pair of conveyor chains on their respective sets of geared rollers. After the casting 305 has entered the second heating stage, the transfer conveyor chain 322 can be stopped and lowered by rotating the angled support links 331, 335 back to their inactive positions, which allows the tray that supports the castings 305 to become supported on the interior end of second primary conveyor chain 316, as illustrated in FIG. 7D. At the same time the intermediate door 314 can descend to close the opening between the first and second heating stages to maintain the temperature differential between the two sections of the furnace. The two primary conveyor chains 312, 316 can then be re-activated to move the transferred casting 305 forward through the second heating stage on the second primary conveyor chain 316 while another casting (not shown) is carried toward the intermediate door 314 by first primary conveyor chain 312.

As indicated above, the invention has been described herein in terms of preferred embodiments and methodologies considered by the inventor to represent the best mode of carrying out the invention. It will be understood by the skilled artisan, however, that a wide range of additions, deletions, and modifications, both subtle and gross, may be made to the illustrated and exemplary embodiments of the composite substrate without departing from the spirit and scope of the invention. These and other revisions might be made by those of skill in the art without departing from the spirit and scope of the invention that is constrained only by the following claims.

What is claimed is:

1. A method for heat treating a casting formed in a high pressure die casting (HPDC) process from an aluminum alloy having a silicon constituent and a plurality of metal alloying constituents, the method comprising:

identifying a predetermined silicon solution temperature at and above which a rate at which the silicon constituent enters into solid solution is accelerated so as to increase growth of internal pores within the casting;

identifying a predetermined alloying metal solution temperature that is greater than the predetermined silicon solution temperature and at and above which a first metal alloying constituent of the plurality of metal alloying constituents enters into solid solution;

wherein the first metal alloying constituent has the highest solution temperature of the plurality of metal alloying constituents;

heating the casting to a first casting temperature less than 10° C. below the predetermined silicon solution temperature, and ensuring that substantially all of the metal alloying constituents of the plurality of metal alloying constituents of the casting are heated to a temperature equal to or greater than the first casting temperature but below the predetermined silicon solution temperature;

increasing the rate of heat input into the casting to heat the casting to a second casting temperature less than 10° C. above the predetermined alloying metal solution temperature;

maintaining the casting at the second casting temperature for a period of time sufficient for the casting to achieve a time-in-treatment ratio greater than about 50%, the time-in-treatment ratio being defined by a duration of time the casting spent above the alloying metal solution temperature divided by a duration of time the casting spent above the silicon solution temperature; and quenching the casting to a temperature less than about 250° C.

2. The method of claim 1, wherein the first casting temperature is less than 5° C. below the predetermined silicon solution temperature.

3. The method of claim 1, wherein the second casting temperature is less than 5° C. above the predetermined alloying metal solution temperature.

4. The method of claim 1, maintaining the casting at the second casting temperature comprises holding the casting at the second casting temperature for a period of time between 2 and 5 minutes.

5. The method of claim 1, wherein the silicon constituent comprises between about 6 weight percent and about 20 weight percent of the aluminum alloy.

6. The method of claim 1, wherein the first metal alloying constituent is selected from the group consisting of copper, magnesium, and manganese.

7. The method of claim 1, wherein the step of heating the casting to a first casting temperature comprises moving the casting into a first heating stage of a furnace maintained at a first stage temperature and heating the casting to the first casting temperature while the casting is in the first heating stage of the furnace; and the step of increasing the rate of heat input into the casting comprises moving the casting from the first heating stage into a second heating stage of the furnace that is separate from the first heating stage and maintained at a second stage temperature that is greater than the first stage temperature and increasing the rate of heat input into the casting, while the casting is in the second heating stage of the furnace, to heat the casting to the second casting temperature; and removing the casting from the second heating stage of the furnace, prior to the quenching step.

8. The method of claim 7, wherein moving the casting from the first heating stage into the second heating stage further comprises moving the casting through an intermediate door separating the first heating stage and the second heating stage.

9. The method of claim 7, wherein the maintaining step comprises maintaining the casting at the second casting temperature for a period of time less than 10 minutes.

10. The method of claim 7, wherein the amount of time the temperature of the casting is above the predetermined silicon solution temperature is substantially equal to the time spent by the casting within the second heating stage.

11. The method of claim 7, wherein the temperature of the casting is at about the first casting temperature when the casting enters the second heating stage.

12. The method of claim 7, wherein the casting achieves a time-in-treatment ratio between about 70% and about 90%.

13. The method of claim 7, wherein the casting achieves a time-in-treatment ratio of 80% or greater.

14. The method of claim 7, wherein the casting achieves a time-in-treatment ratio of about 90%.

15. The method of claim 7, further comprising heating the casting from the first casting temperature to within 5° C. of the second casting temperature in a period of time that is less than about 5 minutes.

16. The method of claim 1, wherein the predetermined silicon solution temperature is greater than approximately 440° C.

17. The method of claim 1, wherein identifying a predetermined alloying metal solution temperature comprises determining a casting temperature profile based upon a weight percentage of each metal alloying constituent of the plurality of metal alloying constituents and solution temperature of each metal alloying component.

18. The method of claim 1, wherein maintaining the casting at the second casting temperature for a period of time that is less than or about 20 minutes.

* * * * *